US009171659B2

(12) United States Patent
Tyrberg et al.

(10) Patent No.: US 9,171,659 B2
(45) Date of Patent: Oct. 27, 2015

(54) RADIAL WATER BARRIER AND A DYNAMIC HIGH VOLTAGE SUBMARINE CABLE FOR DEEP WATER APPLICATIONS

(75) Inventors: Andreas Tyrberg, Lyckeby (SE); Erik Eriksson, Växjö (SE); Johan Ekh, Västerås (SE)

(73) Assignee: ABB Research Ltd, Zürich (CH)

( * ) Notice: Subject to any disclaimer, the term of this patent is extended or adjusted under 35 U.S.C. 154(b) by 0 days.

(21) Appl. No.: 14/419,789

(22) PCT Filed: Sep. 14, 2012

(86) PCT No.: PCT/EP2012/068114

§ 371 (c)(1),
(2), (4) Date: Feb. 18, 2015

(87) PCT Pub. No.: WO2014/040637

PCT Pub. Date: Mar. 20, 2014

(65) Prior Publication Data

US 2015/0248951 A1 Sep. 3, 2015

(51) Int. Cl.

| | |
|---|---|
| ***H01B 7/00*** | (2006.01) |
| ***H01B 7/282*** | (2006.01) |
| ***H01B 7/04*** | (2006.01) |

(52) U.S. Cl.

CPC ..... *H01B 7/282* (2013.01); *H01B 7/045* (2013.01)

(58) Field of Classification Search

CPC ..... H01B 7/14; H01B 7/17; H01B 7/28; H01B 7/282; H01B 7/2825; H01B 7/285

USPC ..... 174/24

See application file for complete search history.

(56) References Cited

U.S. PATENT DOCUMENTS

| | | | | | |
|---|---|---|---|---|---|
| 2,817,363 | A | * | 12/1957 | Penrose | 138/122 |
| 2,870,792 | A | * | 1/1959 | Penrose | 138/121 |
| 3,557,301 | A | * | 1/1971 | Priaroggia | 174/102 D |
| 3,582,536 | A | * | 6/1971 | Miller | 174/102 D |
| 3,754,094 | A | * | 8/1973 | Ziemek et al. | 174/102 A |
| 4,297,526 | A | * | 10/1981 | Leuchs et al. | 174/102 R |
| 4,376,229 | A | * | 3/1983 | Maul et al. | 174/36 |
| 4,398,058 | A | * | 8/1983 | Gerth et al. | 174/106 D |
| 4,674,543 | A | * | 6/1987 | Ziemek et al. | 138/153 |
| 4,749,823 | A | * | 6/1988 | Ziemek et al. | 174/103 |
| 5,043,538 | A | * | 8/1991 | Hughey et al. | 174/107 |

(Continued)

FOREIGN PATENT DOCUMENTS

| | | | |
|---|---|---|---|
| EP | 2 093 775 | A1 | 8/2009 |
| JP | 9-320353 | A | 12/1997 |

OTHER PUBLICATIONS

Ziemek, "Deeply corrugated high flexibility metal cable sheathing", Wire, 1988, vol. 38, No. 2, pp. 231-236.

*Primary Examiner* — Timothy Thompson
*Assistant Examiner* — Rhadames J Alonzo Miller
(74) *Attorney, Agent, or Firm* — Birch, Stewart, Kolasch & Birch, LLP

(57) ABSTRACT

A radial water barrier is provided for a dynamic high-voltage submarine cable. The water barrier includes a corrugated metal tube having an inner diameter in a range of 50-90 mm and a corrugation pitch in a range of 6-10 mm. The metal tube has a wall thickness in a range of 0.7-1 mm and a corrugation depth of more than 6 mm.

20 Claims, 1 Drawing Sheet

(56) References Cited

U.S. PATENT DOCUMENTS

| | | | | |
|---|---|---|---|---|
| 5,181,316 | A * | 1/1993 | Pote et al. | 29/828 |
| 5,389,736 | A | 2/1995 | Ziemek et al. | |
| 5,527,995 | A | 6/1996 | Lasky | |
| 5,760,334 | A * | 6/1998 | Ziemek | 174/28 |
| 6,255,591 | B1 * | 7/2001 | Ziemek | 174/102 R |
| 6,624,358 | B2 * | 9/2003 | Krabec et al. | 174/102 D |
| 7,044,785 | B2 * | 5/2006 | Harwath et al. | 439/585 |
| 8,779,293 | B2 * | 7/2014 | Cho et al. | 174/102 D |
| 2008/0190849 | A1 * | 8/2008 | Vuong | 210/652 |
| 2009/0183892 | A1 * | 7/2009 | Ziemek | 174/108 |
| 2010/0051546 | A1 * | 3/2010 | Vuong et al. | 210/637 |

* cited by examiner

RADIAL WATER BARRIER AND A DYNAMIC HIGH VOLTAGE SUBMARINE CABLE FOR DEEP WATER APPLICATIONS

FIELD OF THE INVENTION

The present invention relates to a radial water barrier for a dynamic high-voltage submarine cable and a dynamic high-voltage submarine cable for deep water applications. The invention also relates to the use of a radial water barrier to prevent moisture from penetrate in the electrical insulation system of a dynamic high voltage cable in deep water applications.

PRIOR ART

There is a need of power transmission with high voltage cables between shore and floating oil and gas platforms. With high voltage is meant voltages equal to or above 36 kV. A floating platform can be power supplied with power from shore with a high voltage dynamic cable system. A conceptual layout of a dynamic cable system is presented in FIG. 1. The cable system includes a dynamic cable 1 and a static cable 4. One end of the dynamic cable 1 is connected to a floating platform 2 and the other end of the cable is connected to the static cable 4 with a joint 5. The static cable 4 rests on the bottom of the sea, and is normally protected through trenching or rock dumping, and the dynamic cable 1 externs from the platform 2 to the static cable on the bottom of the sea. A number of buoyancies 3 can be mounted on the dynamic cable 1 to configure the dynamic cable in an appropriate manner, this in order to account for the movement of the cable. The movements of the platform will induce mechanical load and fatigue on the dynamic cable 1. In general, the most severe fatigue load typically occurs in the vicinity to the platform attachment point, i.e. at water depths of 0-30 meters. In this region the cable is exposed to high mechanical load and fatigue due to the movements of the platform and a low hydrostatic pressure due to the small depth. The static cable 4 is resting on the bottom at deep water and is not exposed to any reoccurring movement. Thus, the static cable is exposed to low mechanical load and high hydrostatic pressure due to the large water depth.

The dynamic cable comprises a core including at least one electrical conductor, each separately surrounded by an electrical insulation system. Submarine high voltage cables are in general equipped with a radial water barrier embracing each cable core. The radial water barrier prevents moisture penetration into the electrical insulation system that can initiate electrical breakdown of the cable. A standard static submarine cable is equipped with a lead sheath as a radial water barrier. The lead sheath protects the cable against moisture, but does not impair the flexibility of the cable. Due to the high static pressure on the static cable, the water barrier must have a high mechanical strength. A corrugated metal sheath has been developed as an alternative to the lead sheath. The corrugation gives the sheath greater strength as well as better flexibility. Corrugated metal sheaths for electrical cables are, for example, known from U.S. Pat. No. 5,527,995.

The properties of the radial water barrier are determined by the material and the geometrical dimensions of the sheath, such as the thickness of the sheath, and the corrugation geometry. The main dimensions in the geometry are the corrugation depth and the distance between two neighboring corrugation crests, also denoted the corrugation pitch.

A deeply corrugated metal sheath that can withstand very high pressure is disclosed in an article "Deeply corrugated high flexibility metal cable sheathing" by Dr-Ing G. Zimek, Wire 38 (1988) 2, page 231-236. The deeply corrugated metal tube is suitable for cables used in places where there are conditions of extreme pressure, e.g. over 100 Bar, such as in offshore area or in the oil industry. High-voltage submarine cable cores have a rather large diameter. Typically the cores have a diameter in the range of 50-90 mm, and accordingly the inner diameter of the radial water barrier of a high-voltage submarine cable must have an inner diameter in a corresponding range. The metal sheaths shown in this article have an inner diameter in the range of 11.1-31.5 mm and thus are not high-voltage cables.

U.S. Pat. No. 5,760,334 proposes geometrical dimensions for three types of water barriers made of a copper alloy for cables with different diameters. One of the proposed water barriers has an inner diameter of 67 mm and is accordingly suitable for high-voltage submarine cables. This water barrier is proposed to have a sheath thickness of 0.5 mm, a corrugation pitch of 7.1 mm and a corrugation depth of 2.15 mm. The mechanical strength of the sheath, particularly, the stability and crush resistance, are achieved by using a lower corrugation depth and a shorter corrugation pitch, as compared to previously known corrugated tubes, i.e. the number of corrugation per unit length is increased.

So far high voltage cable systems have been installed at approximately 300-400 meters of water depths. However, floating oil and gas platforms are operating at deep and ultra-deep waters. Thus, there is a need to provide cables for power transmission at deep and ultra-deep waters. Several challenges exist in order to close technology gaps related to the power cable in order to qualify them for deep and ultra-deep waters. The main mechanical challenges for a dynamic cable system include its resistance to fatigue load and hydrostatic pressure. If the high voltage cable systems are installed at depth significantly larger than 400 m, the upper part of the cable will be exposed to high mechanical load and fatigue due to the movements of the platform and the lower part of the cable will be exposed to a high hydrostatic pressure due to the large water depth. Thus, the dynamic cable must be designed to resist mechanical load and fatigue as well as a high hydrostatic pressure. Those two parameters are often opposing when finding a corrugation design, which means that a sheath that has beneficial fatigue properties has poor hydrostatic pressure properties and vice versa. An increase of water depth will require a new corrugation design of the radial water barrier of the dynamic cable in order to withstand the pressure but without renounce its fatigue properties.

OBJECT AND SUMMARY OF THE INVENTION

The object of the present invention is to provide a dynamic cable that has beneficial fatigue properties and is able to withstand the hydrostatic pressure at deep or ultra-deep waters.

According to one aspect of the invention this object is achieved by a radial water barrier as defined in claim 1.

The water barrier comprises a corrugated metal tube having an inner diameter in a range of 50-90 mm and a corrugation pitch in a range of 6-10 mm, a wall thickness in a range of 0.7-1 mm, and a corrugation depth of more than 6 mm.

According to the invention, a radial water barrier with beneficial fatigue properties and an improved resistant to hydrostatic pressure is achieved by increasing the wall thickness and the corrugation depth compared to known corrugated radial water barriers. The water barrier is in particular suitable for core diameters typical for high voltage cables.

Tests have proven that a deeply corrugated tube with those geometrical dimensions has improved fatigue properties and can withstand significant hydrostatic pressure, and is able to qualify for at least 900 to 1000 meters of water depth. The test tube was made of copper. However, the tube can also be made of another metal, such as stainless steel or a copper alloy.

According to an embodiment of the invention, the corrugation depth is more than 7 mm. This embodiment has further improved fatigue properties and improved resistant to hydrostatic pressure. For example, if the water barrier is made of copper the water barrier can be used at depth down to about 700 to 1100 m, and if the water barrier is made of stainless steel the water barrier can be used at a depth down to about 1800 to 2800 m.

According to an embodiment of the invention, the corrugation depth is more than 8 mm. This embodiment has further improved fatigue properties and improved resistant to hydrostatic pressure. For example, if the water barrier is made of copper the water barrier can be used at depth down to about 800 to 1200 m, and if the water barrier is made of stainless steel the water barrier can be used at a depth down to about 2000 to 3000 m.

According to an embodiment of the invention, the corrugation pitch is in a range of 6-9 mm. This embodiment further improves the fatigue properties and the resistant to hydrostatic pressure.

According to an embodiment of the invention, the corrugation pitch is in a range of 6-8 mm. This embodiment further improves the fatigue properties and the resistant to hydrostatic pressure.

According to an embodiment of the invention, the corrugation pitch is in a range of 7.2-10 mm. This embodiment is easy to manufacture and still has satisfactory fatigue properties and resistant to hydrostatic pressure.

According to another aspect of the invention this object is achieved by a dynamic high-voltage submarine cable for deep water applications as defined in claim 8.

A first end of the dynamic cable is adapted for connection to a floating platform and a second end of the dynamic cable is adapted for connection to a static cable, and the dynamic cable comprises at least one electrical conductor surrounded by an electrical insulation system and a radial water barrier arranged to prevent moisture to penetrate in the electrical insulation system and comprising a corrugated metal tube having an inner diameter between 50-90 mm and a corrugation pitch in a range of 6-10 mm. The metal tube has a wall thickness in a range of 0.7-1 mm and a corrugation depth of more than 6 mm.

The invention also relates to the use of a radial water barrier to prevent moisture from penetrate in the electrical insulation system of a dynamic high voltage cable in deep water applications.

The invention also relates to the use of a radial water barrier in a dynamic high voltage cable for water applications deeper than 600 m.

The invention also relates to the use of a radial water barrier in a dynamic high voltage cable for water applications deeper than 1000 m.

The water barrier according to the invention can be used for AC as well as DC cables.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1:
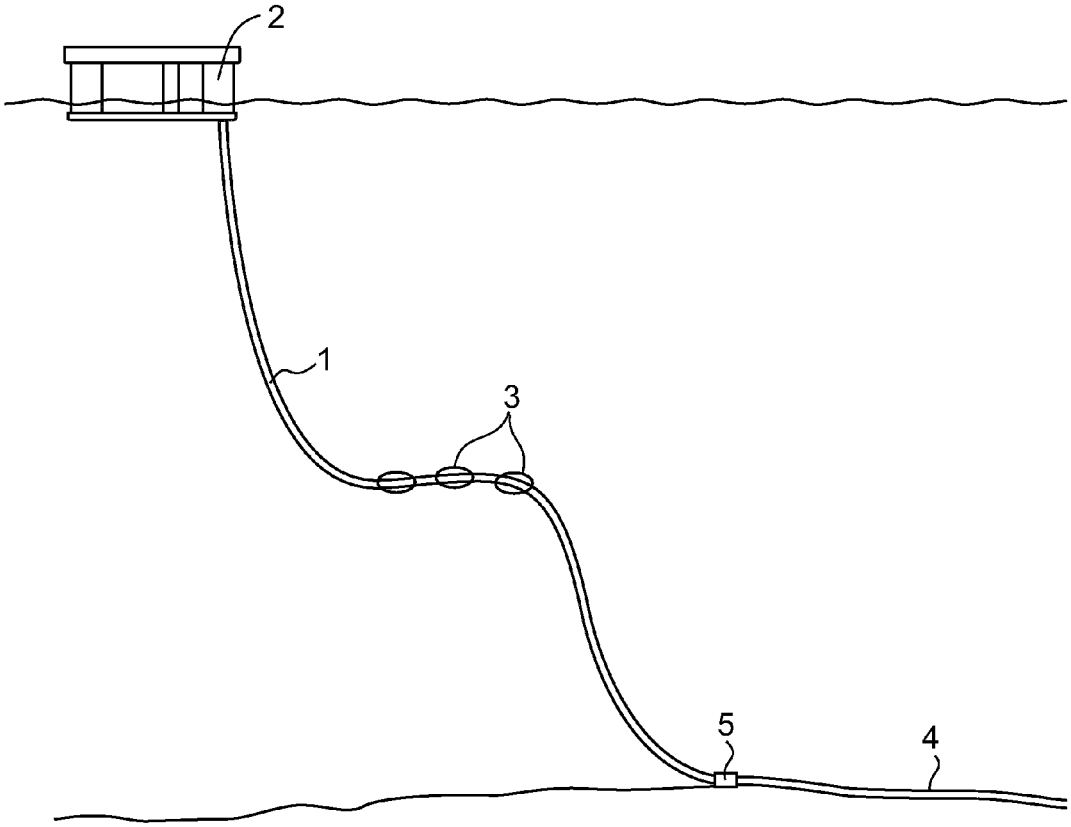
FIG. 1 shows a conceptual layout of a dynamic cable system.
Figure 2:
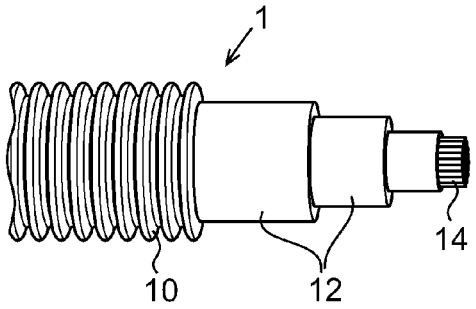
FIG. 2 shows a dynamic high-voltage submarine cable including a corrugated water barrier according to an embodiment of the invention.

FIG. 2 shows a dynamic high-voltage submarine cable 1 according to an embodiment of the invention. The dynamic cable includes an electrical conductor 14 surrounded by an electrical insulation system 12 and a radial water barrier 10 arranged to prevent moisture to penetrate in the electrical insulation system. The water barrier consists of a corrugated metal tube 10. Although the invention is exemplified by a dynamic DC cable, the invention is not limited to DC cables. The invention is applicable to AC cables as well.

Figure 3:
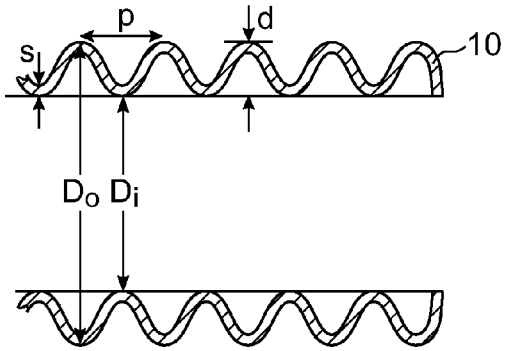
FIG. 3 shows a longitudinal cross section through the corrugated water barrier shown in FIG. 2.

FIG. 3 shows corrugation geometries for the corrugated metal tube 10. The metal tube has a wall thickness in the range of 0.7-1 mm. The metal tube 10 is preferably made of pure copper, a copper alloy, or stainless steel. The crests of the corrugation are annularly or helically shaped. In the embodiment disclosed in FIGS. 2 and 3 the crests are annularly shaped. The corrugation pitch p is the distance between two neighboring corrugation crests. The corrugation pitch p is in the range of 6-10 mm, preferably in the range of 6-9 mm, and more preferably in the range of 6-8 mm in order to improve the fatigue properties and the resistant to hydrostatic pressure. A smaller pitch improves the fatigue properties and the resistant to hydrostatic pressure. However, a larger pitch makes it easier to manufacture the corrugation. A corrugation pitch in the range of 7.2-10 mm is easy to manufacture and still has satisfactory fatigue properties and resistant to hydrostatic pressure.

The inner diameter Di of the metal tube 10 is governed by the outer diameter of the insulation system 12 of the cable and is in the range of 50-90 mm. The outer diameter Do of the metal tube 10 depends on the corrugation depth d.

$$d=(Do-Di)/2$$

According to the invention, the corrugation depth d is larger than 6 mm, preferably larger than 7 mm, and more preferably larger than 8 mm. The corrugation depth d is preferably less than 10 mm. However, the manufacturing of the corrugated tube sets an upper limit of the corrugation depth.

In the table below, the maximum water depth and the fatigue properties for some different sheath designs is presented. As can be seen, increasing the corrugation depth results in a design with better hydrostatic properties and improved fatigue properties. Reducing the pitch will also result in an increased water depth and improved fatigue properties. By simultaneously increasing the corrugation depth and decreasing the pitch the largest resistance to hydrostatic pressure and the best fatigue properties are achieved.

| Material | Do | Di | s | p | d | Water Depth | Fatigue properties |
|---|---|---|---|---|---|---|---|
| Copper | 70 | 56 | 0.8 | 8 | 7 | 800 | + |
| Copper | 74 | 56 | 0.8 | 8 | 9 | 950 | ++ |
| Copper | 70 | 56 | 0.8 | 6.5 | 7 | 950 | ++ |
| Copper | 74 | 56 | 0.8 | 6.5 | 9 | 1100 | +++ |
| Steel | 70 | 56 | 0.8 | 8 | 7 | 2000 | + |
| Steel | 74 | 56 | 0.8 | 8 | 9 | 2350 | ++ |
| Steel | 70 | 56 | 0.8 | 6.5 | 7 | 2350 | ++ |
| Steel | 74 | 56 | 0.8 | 6.5 | 9 | 2800 | +++ |

The present invention is not limited to the embodiments disclosed but may be varied and modified within the scope of the following claims. For example, the values of the corrugation pitch and depth can be varied within the described ranges and still achieve improved resistance to hydrostatic pressure and fatigue properties.

The invention claimed is:

1. A radial water barrier for a dynamic high-voltage submarine cable, wherein the water barrier comprises a corrugated metal tube having an inner diameter in a range of 50-90 mm and a corrugation pitch in a range of 6-10 mm, wherein the metal tube has a wall thickness in a range of 0.7-1 mm and a corrugation depth of more than 6 mm.

2. The radial water barrier according to claim 1, wherein the corrugation depth is more than 7 mm.

3. The radial water barrier according to claim 1, wherein the corrugation depth is more than 8 mm.

4. The radial water barrier according to claim 1, wherein the corrugation in a range of 6-9 mm.

5. The radial water barrier according to claim 1, wherein the corrugation pitch is in a range of 6-8 mm.

6. The radial water barrier according to claim 1, wherein the corrugation pitch is in a range of 7.2-10 mm.

7. The radial water barrier according to claim 1, wherein the metal tube is made of copper, a copper alloy or stainless steel.

8. A dynamic high-voltage submarine cable for deep water applications, wherein a first end of the cable is adapted for connection to a floating platform and a second end of the cable is adapted for connection to a static cable, and the dynamic cable comprises at least one electrical conductor surrounded by an electrical insulation system and a radial water barrier arranged to prevent moisture to penetrate in the electrical insulation system and comprising a corrugated metal tube having an inner diameter between 50-90 mm and a corrugation pitch in a range of 6-10 mm, wherein the metal tube has a wall thickness in a range of 0.7-1 mm and a corrugation depth of more than 6 mm.

9. The dynamic power cable according to claim 8, wherein the corrugation depth is more than 7 mm.

10. The dynamic power cable according to claim 8, wherein the corrugation depth is more than 8 mm.

11. The dynamic power cable according to claim 8, wherein the corrugation pitch is in a range of 6-9 mm.

12. The dynamic power cable according to claim 8, wherein the corrugation pitch is in a range of 6-8 mm.

13. The dynamic power cable according to claim 8, wherein the metal tube is made of copper, a copper alloy, or stainless steel.

14. Use of a radial water barrier according to claim 1 to prevent moisture from penetrate in the electrical insulation system of a dynamic high voltage cable in deep water applications.

15. Use of a radial water barrier according to claim 1 to prevent moisture from penetrate in the electrical insulation system of a dynamic high voltage cable in water applications deeper than 600 m.

16. Use of a radial water barrier according to claim 1 to prevent moisture from penetrate in the electrical insulation system of a dynamic high voltage cable in water applications deeper than 1000 m.

17. The radial water barrier according to claim 2, wherein the corrugation in a range of 6-9 mm.

18. The radial water barrier according to claim 2, wherein the corrugation pitch is in a range of 6-8 mm.

19. The radial water barrier according to claim 2, wherein the corrugation pitch is in a range of 7.2-10 mm.

20. The radial water barrier according to claim 2, wherein the metal tube is made of copper, a copper alloy or stainless steel.

* * * * *